US007004996B2

(12) United States Patent
Ciccarelli

(10) Patent No.: US 7,004,996 B2
(45) Date of Patent: Feb. 28, 2006

(54) PROCESS FOR THE REMOVAL OF THE HYDROGEN SULFIDE CONTAINED IN NATURAL GAS

(75) Inventor: Liberato Giampaolo Ciccarelli, San Giuliano Milanese (IT)

(73) Assignee: ENI S.p.A., Rome (IT)

( * ) Notice: Subject to any disclaimer, the term of this patent is extended or adjusted under 35 U.S.C. 154(b) by 83 days.

(21) Appl. No.: 10/736,850

(22) Filed: Dec. 17, 2003

(65) Prior Publication Data

US 2004/0163537 A1 Aug. 26, 2004

(30) Foreign Application Priority Data

Dec. 20, 2002 (IT) ..... MI2002A2709

(51) Int. Cl.
*B01D 53/14* (2006.01)

(52) U.S. Cl. ..... 95/193; 95/235

(58) Field of Classification Search ..... 95/187, 95/193, 209, 211, 235, 236; 423/220, 226; 585/833, 867; 62/620, 625, 632, 636; 208/238
See application file for complete search history.

(56) References Cited

U.S. PATENT DOCUMENTS 2,870,868 A 1/1959 Eastman et al.
3,918,934 A * 11/1975 Kriebel et al. ..... 95/166
4,971,607 A 11/1990 Gazzi et al.
5,321,952 A 6/1994 Forte
5,782,958 A * 7/1998 Rojey et al. ..... 95/192
6,368,385 B1 * 4/2002 Paradowski ..... 95/181

FOREIGN PATENT DOCUMENTS

EP 0129704 A1 * 1/1985
EP 1 029 910 8/2000
GB 2 323 093 9/1998

* cited by examiner

*Primary Examiner*—Frank M. Lawrence
(74) *Attorney, Agent, or Firm*—Oblon, Spivak, McClelland, Maier & Neustadt, P.C.

(57) ABSTRACT

Process for the removal of the hydrogen sulfide contained in natural gas, which comprises:
a. absorbing the hydrogen sulfide present in natural gas by means of a virgin naphtha, in an adsorbing device and with a molar ratio virgin naphtha/$H_2S$ ranging from 0.85 to 1.5;
b. recovering the hydrogen sulfide absorbed by the virgin naphtha as head product of a distillation column operating with a reflux having a temperature of between −5 and −20° C.;
c. recycling the virgin naphtha discharged as bottom product of the distillation column, to the absorption step (a);
d. introducing the hydrogen sulfide back to the production field of natural gas, at the temperature and pressure conditions present at the head of the distillation column.

5 Claims, 1 Drawing Sheet

PROCESS FOR THE REMOVAL OF THE HYDROGEN SULFIDE CONTAINED IN NATURAL GAS

BACKGROUND OF THE INVENTION

Figure 1:
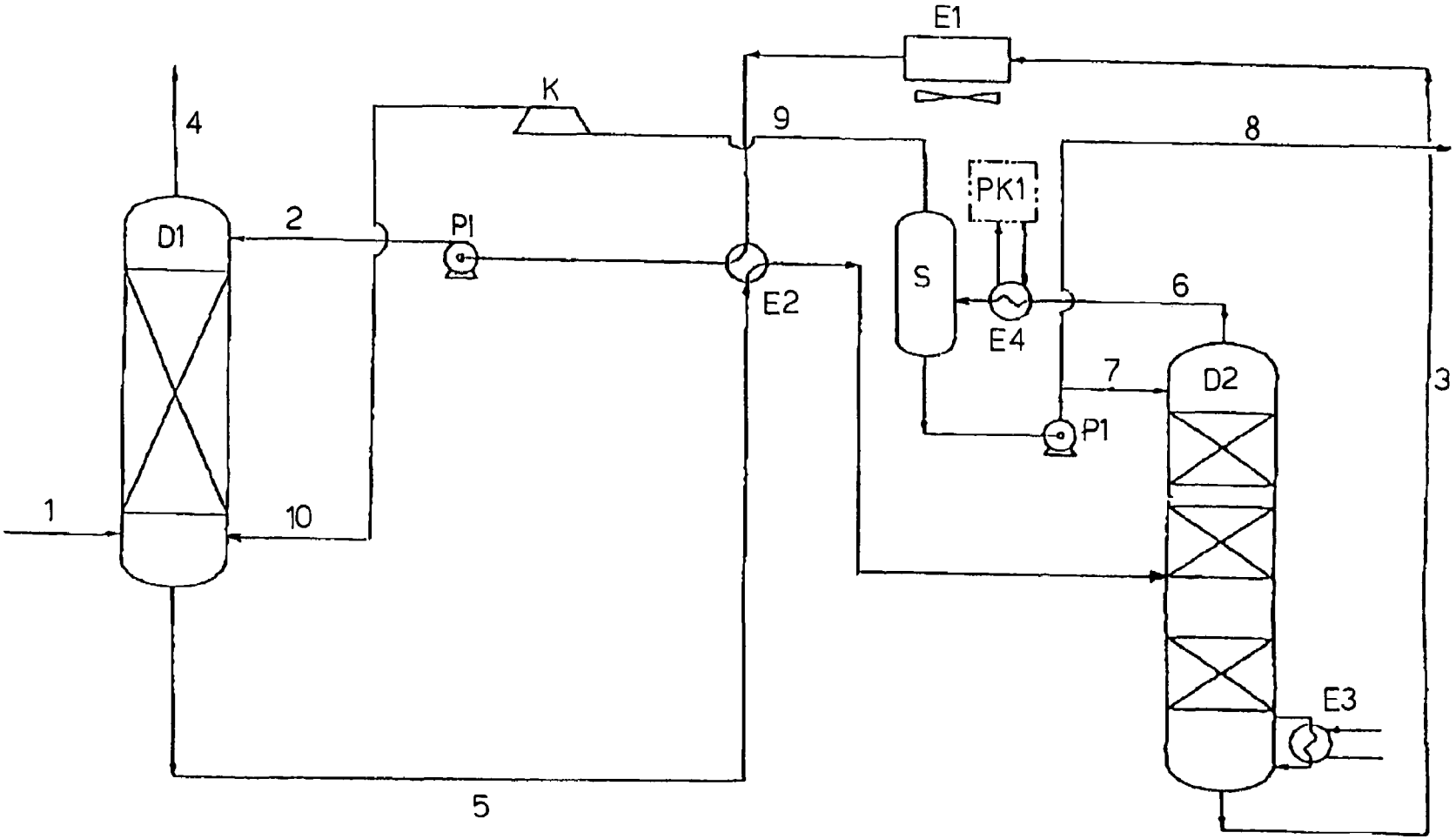

The present invention relates to a process for the removal of hydrogen sulfide contained in natural gas.

More specifically, the present invention relates to a process for the reduction of the hydrogen sulfide contained in natural gas to concentrations lower than 1% molar.

It is known that natural gas has now become a source of thermal energy which represents one of the main alternatives to traditional fuels of a fossil nature, in particular to the fuel oils of petroleum origin, which are considered as being one of the main causes of the greenhouse effect which influences the earth's climate.

Natural gas, coming from production fields, mainly consists of methane but can also contain, in addition to significant traces of higher $C_2$–$C_{7+}$ hydrocarbons, variable quantities of inert or polluting gases, for example, carbon dioxide or $H_2S$, whose presence must be eliminated or reduced in order to meet the specifications for use.

Said specifications include respecting the Wobbe index, a parameter defined by the ratio between the thermal value (upper or lower) of gas and its density with respect to air, as well as the a $H_2S$ content which must be practically null.

Methods for the removal of inert or polluting gases from natural gas, nitrogen or hydrogen sulfide in particular, are known in scientific literature. Most of these processes, however, are essentially based on cryogenic removal, as in the case of nitrogen, or on removal by absorption with alkyl amines, as in the case of hydrogen sulfide, with generally efficacious but uneconomic results. In particular, there are natural gas fields where the concentration of hydrogen sulfide is so high that their exploitation is not convenient from an economic point of view, due to the high costs for the separation and treatment of the polluting product ($H_2S$). Particularly relevant is the treatment step of hydrogen sulfide which, after separation, is transformed to elemental sulfur, with consequent disposal problems.

A process for the removal of hydrogen sulfide from natural gas has now been found by the Applicant, which allows the polluting product to be recovered at a pressure substantially equal to that of the production of natural gas, making it therefore possible to introduce the polluting product itself back to the production field. In this way, all problems associated with transforming the hydrogen sulfide into sulfur and with the disposal of the latter, are completely eliminated.

SUMMARY OF THE INVENTION

An object of the present invention is therefore a process for the removal of the hydrogen sulfide contained in natural gas, which comprises:

a) absorbing the hydrogen sulfide present in natural gas by means of a virgin naphtha, essentially consisting of $C_5$–$C_8$ paraffins, in an adsorbing device and with a molar ratio virgin naphtha/$H_2S$ of between 0.85 and 1.5;

b) recovering the hydrogen sulfide absorbed by the virgin naphtha as head product of a distillation column operating with a reflux having a temperature ranging from −5 to −20° C.;

c) recycling the virgin naphtha, discharged as bottom product of the distillation column, to the absorbing step (a);

d) introducing the hydrogen sulfide back to the production field of natural gas, at the temperature and pressure conditions present at the head of the distillation column.

DETAILED DESCRIPTION OF THE PREFERRED EMBODIMENTS

The natural gas fed to the absorbing step is normally pre-treated to eliminate or reduce the higher hydrocarbons and other gases such as, for example, carbon dioxide, possibly present. The pre-treatment operations include feeding the gas to a filtering and heating unit. The $CO_2$ and any possible traces of humidity can be eliminated through membrane permeation. More detailed information on membrane permeation can be found in "Polymeric Gas Separation Membranes" R. E. Kesting, A. K. Fritzsche, Wiley Interscience, 1993.

The absorbing step is preferably carried out in a tray column or filling column, by feeding the natural gas to the bottom and virgin naphtha to the head.

The term "virgin naphtha" as used in this description and in the claims, refers to an oil cut essentially consisting of a mixture of hydrocarbons liquid at room temperature, wherein the number of carbon atoms of each component is mainly between 5 and 8, and having an average boiling point between about 35° C. of pentane and about 125° C. of octane.

The absorption is mainly effected at room temperature and at a pressure equal to that of the production of natural gas, in tray columns or filling columns, in which the filling is preferably randomly arranged. A gaseous stream consisting of the natural gas in which the concentration of $H_2S$ is lower than 1% mole, and generally between 0.1 and 0.8%, is discharged from the head of the column, whereas the absorbing fluid containing hydrogen sulfide is collected at the bottom.

As the natural gas discharged from the head of the absorption column, is substantially at the same pressure present in the reservoir, it can be fed directly to the distribution network, after undergoing a second purification treatment with amines in order to bring the concentration of $H_2S$ substantially to zero. The second purification treatment can be effected with the traditional absorption systems of alkyl amines, as the concentration of $H_2S$ is low.

The virgin naphtha containing hydrogen sulfide is treated in the distillation column, operating at the same pressure, or slightly lower than the pressure of the absorption column. The distillation column operates with a temperature at the head which is such as to guarantee the liquid state of the hydrogen sulfide at the operating pressure. This temperature generally ranges from −5 to −20° C., preferably from −9 to −15° C.

The virgin naphtha is collected from the bottom of the distillation column, substantially without $H_2S$, and is recycled to the absorption column, whereas hydrogen sulfide in liquid state is recovered at the head, which, as it is substantially at the same pressure present in the reservoir, can be easily readmitted thereto The process for the removal of hydrogen sulfide contained in natural gas, object of the present invention, can be better understood by referring to the drawing of the enclosed FIG. 1, which represents an illustrative but non-limiting embodiment.

The natural gas containing $H_2S$ (1) coming from the production field, is fed to the bottom of the absorption column D1. Virgin naphtha is fed to the head of the column D1, through the feeding line (2). Virgin naphtha normally comes from recycling (3).

A gaseous stream (4), essentially consisting of natural gas with an $H_2S$ content lower than 1% molar, is extracted from the head of the column D1. The gas thus purified cannot be sent directly to the distribution network and is therefore refined with amines until the $H_2S$ content is reduced to below 4 ppm. The liquid collected at the bottom of the extractor D1, mainly consisting of virgin naphtha and the absorbed hydrogen sulfide, is fed through line 5 to the heat exchanger E2 to be pre-heated and, subsequently, to the distillation column D2 which operates with a reboiler E3 placed at the bottom of the column.

A stream of vapours (6), essentially consisting of $H_2S$, is discharged from the head of the column D2. The stream of vapours (6) is dehydrated, cooled and condensed in the recovery exchanger E4, integrated with the cooling cycle PK1 and is subsequently sent to the separator S.

The liquid collected at the bottom of the separator S is recovered by means of the pump P1 and is sent, by the same pump, to the reservoir through line (8) and, partially recycled as reflux (7) to D2.

The virgin naphtha (3) is recovered from the bottom of the column D2, is cooled, first in the air exchanger E1 and then in the exchanger E2, and is pumped to the head of the absorption column D1, by means of P2. In the same way, the non-condensed vapours (9) coming from S are fed (10) to the absorption column D1 by means of the compressor K.

An experimental test, operating according to the scheme of the enclosed figure, is described hereunder for illustrative and non-limiting purposes.

Natural gas is used, available at 60 bar, having the following composition:

| | moles % |
|---|---|
| $C_1$ | 83 |
| $CO_2$ | 2 |
| $H_2S$ | 15 |

60,000 $Sm^3/d$ of this gaseous stream are fed to the bottom of the absorption filling column D1, operating at about 60 bar, a temperature at the head of 20° C., a temperature at the bottom of 20° C. The recycled virgin naphtha (2) is fed (2) to the head of the column, at a temperature of 20–25° C. and a pressure of about 62 bar, containing about 1% moles of hydrogen sulfide. A mixture essentially consisting of $C_5$–$C_8$ hydrocarbons, with an average boiling point of about 95° C., is used as virgin naphtha.

A stream (4) of about 51,000 $Sm^3/d$, consisting of natural gas with an $H_2S$ content of about 1% moles, is recovered from the head of the absorption column D1.

A liquid stream (5) consisting of virgin naphtha containing $H_2S$, is discharged from the bottom of the column D1. This stream is first preheated to 120° C. in E2 and then sent to the distillation column D2, operating with a temperature at the head of about −15° C. and a temperature at the bottom of about 220° C.

A gaseous stream is recovered from the head of the column D2, mainly consisting of hydrogen sulfide vapours which are condensed at about −15° C. in E4 and collected in S. 1,000 $Sm^3/d$ of liquefied $H_2S$ are refluxed (7) to the head of D2, whereas 10,000 $Sm^3/d$ of liquefied $H_2S$ (8) are sent back to the production reservoir.

100 $Sm^3/d$ of virgin naphtha (3) are recovered from the bottom of the column D2, are cooled to 20–25° C. and then pumped (2) to the absorption column.

The invention claimed is:

1. A process for the removal of the hydrogen sulfide contained in natural gas, including:

a) absorbing the hydrogen sulfide present in natural gas by means of a virgin naphtha, essentially consisting of $C_5$–$C_8$ paraffins, in an absorbing device and with a molar ratio virgin naphtha/$H_2S$ of between 0.85 and 1.5;

b) recovering the hydrogen sulfide absorbed by the virgin naphtha as head product of a distillation column operating with a reflux having a temperature ranging from −5 to −20° C.;

c) recycling the virgin naphtha discharged as bottom product of the distillation column, to the absorption step (a);

d) introducing the hydrogen sulfide back to the production field of natural gas, at the temperature and pressure conditions present at the head of the distillation column.

2. The process according to claim 1, wherein the natural gas is pre-treated to eliminate carbon dioxide.

3. The process according to claims 1 or 2, wherein the absorption step is effected in a filling column.

4. The process according to claims 1 or 2 wherein the absorption step is effected at room temperature.

5. The process according to claims 1 or 2 wherein the distillation column operates at a head temperature of between −9 and −15° C.

* * * * *